US006790009B1

(12) United States Patent
Carbajal

(10) Patent No.: US 6,790,009 B1
(45) Date of Patent: Sep. 14, 2004

(54) FAN GRILL ASSEMBLY

(75) Inventor: Francisco Javier Carbajal, Arlington, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 10/456,201

(22) Filed: Jun. 9, 2003

(51) Int. Cl.[7] ..... F04D 29/70
(52) U.S. Cl. ..... 416/247 R
(58) Field of Search ..... 416/247 R; 415/121.2

(56) References Cited

U.S. PATENT DOCUMENTS 2,498,968 A * 2/1950 Viewegh ..... 416/247 R
3,963,382 A * 6/1976 Patton ..... 416/247 R
5,547,343 A 8/1996 Jane et al.
5,678,830 A * 10/1997 Chang ..... 277/631
6,213,718 B1 4/2001 Hill et al.
6,454,537 B1 9/2002 Percella et al.

* cited by examiner

*Primary Examiner*—Christopher Verdier
(74) *Attorney, Agent, or Firm*—Baker Donelson

(57) ABSTRACT

A fan (10) is disclosed having a base (11), a motor housing (12) encasing an electric motor (13), a blade assembly (14) coupled to the motor, and a grill assembly (15) surrounding the blade assembly. The grill assembly includes a front grill (17), a rear grill (18) and a split mounting ring (19). The rear grill includes a peripheral rim (22). The front grill includes a peripheral rim (26), a bottom flange (32) and a top flange (33). The bottom flange and top flange are configured to releasably engage the peripheral rim of the rear grill. The split mounting ring has an inwardly facing channel (34) therein sized and shaped to encase substantially the peripheral rims of the rear and front grills. The mounting ring has a first end (36) having an internally threaded receiver (37) and a catch (38) therein. The mounting ring also has second end (40) has a mounting bolt (41) rotatably mounted thereto which is configured to be threadably received within the first end receiver, and a spring biased latch (42) configured to be releasably received within the first end catch.

13 Claims, 4 Drawing Sheets

FAN GRILL ASSEMBLY

TECHNICAL FIELD

This invention relates to fans and more specifically to their protective grill assemblies.

BACKGROUND OF THE INVENTION

Electrically powered fans typically have a motor mounted within a stationary base that is positioned upon a table or a floor. In operation, the motor rotates an annular array of blades. These blades are typically encased within a protective safety grill to prevent direct access to the rotating blades.

Fans are sometimes sold at retail with their safety grills packed separately from the fan blades for compactness. Once the components are unpacked by the buyer the safety grill must be mounted in place to protect individuals from the blades. To do this, the grills have typically been designed in two halves, a front half and a rear half. These two halves are positioned on either side of the blades and then coupled together to form a complete safety grill. These two grill halves are typically coupled together with the use of mounting screws which are passed from one half to the other, as shown in U.S. Pat. No. 5,547,343. This work has been tedious and cumbersome as the installer must align the mounting holes of the grill halves and torque the screws all while having to hold the grill halves together. These two grill halves are also disconnected and later reconnected to each other in order to gain access to the blades during periodic cleaning.

Fans have been designed to be coupled together by one grill half having an annular array of peripheral slots while the other grill half has an annular array of tabs which mate with the slots, as shown in U.S. Pat. No. 6,454,537. These types of tabs however often break or become loose over time causing a dismounting process of the two halves. A variation of this concept is shown in U.S. Pat. No. 6,213,718 wherein hooks are utilized to grasp the peripheral rim of a grill.

Fans have also been designed to have these two grill halves held together by an expandable mounting ring. Here, each grill half has a peripheral flange of approximately the same size and shape which when adjacent each other are positioned within an inwardly facing channel in the expanded mounting ring. The ends of the mounting ring are then brought together to encase the peripheral flanges of the two halves and thereby fix their position. The ends are typically brought together with a mounting bolt that passes from one end of the mounting ring to the other, which when tightened brings the two ends together and thereby slightly collapses the ring. This design has proven to be difficult to assemble as the installer must keep the two halves aligned, while positioning the ring about the peripheral flanges, all while simultaneously attempting to torque the mounting bolt and manually maintaining the ends in close proximity to each other.

Accordingly, it is seen that a need remains for a fan capable of having its grill mounted and dismounted in a more efficient and easier manner. It is to the provision of such therefore that the present invention is primarily directed.

SUMMARY OF THE INVENTION

In a preferred form of the invention a fan comprises a base, an electric motor coupled to the base, an annular array of blades mounted to the motor, a first grill half having a peripheral rim, a second grill half having a peripheral rim, and a mounting ring. The mounting ring has a channel therein sized and shaped to receive the first grill half peripheral rim and the second grill half peripheral rim. The mounting ring also has a first end and a second end, one end having a latch mounted thereon configured to be received by a catch associated with the other end. The mounting ring also has locking means for locking the ends together. With this construction, the mounting ring captures the peripheral rims of the two grill halves and the ends are temporarily coupled together through the use of the latch and catch, and the ends are then locked together through the use of the locking means without requiring an installer to manually maintain the relative positions of the ends during the locking process.

DETAILED DESCRIPTION

Figure 1:
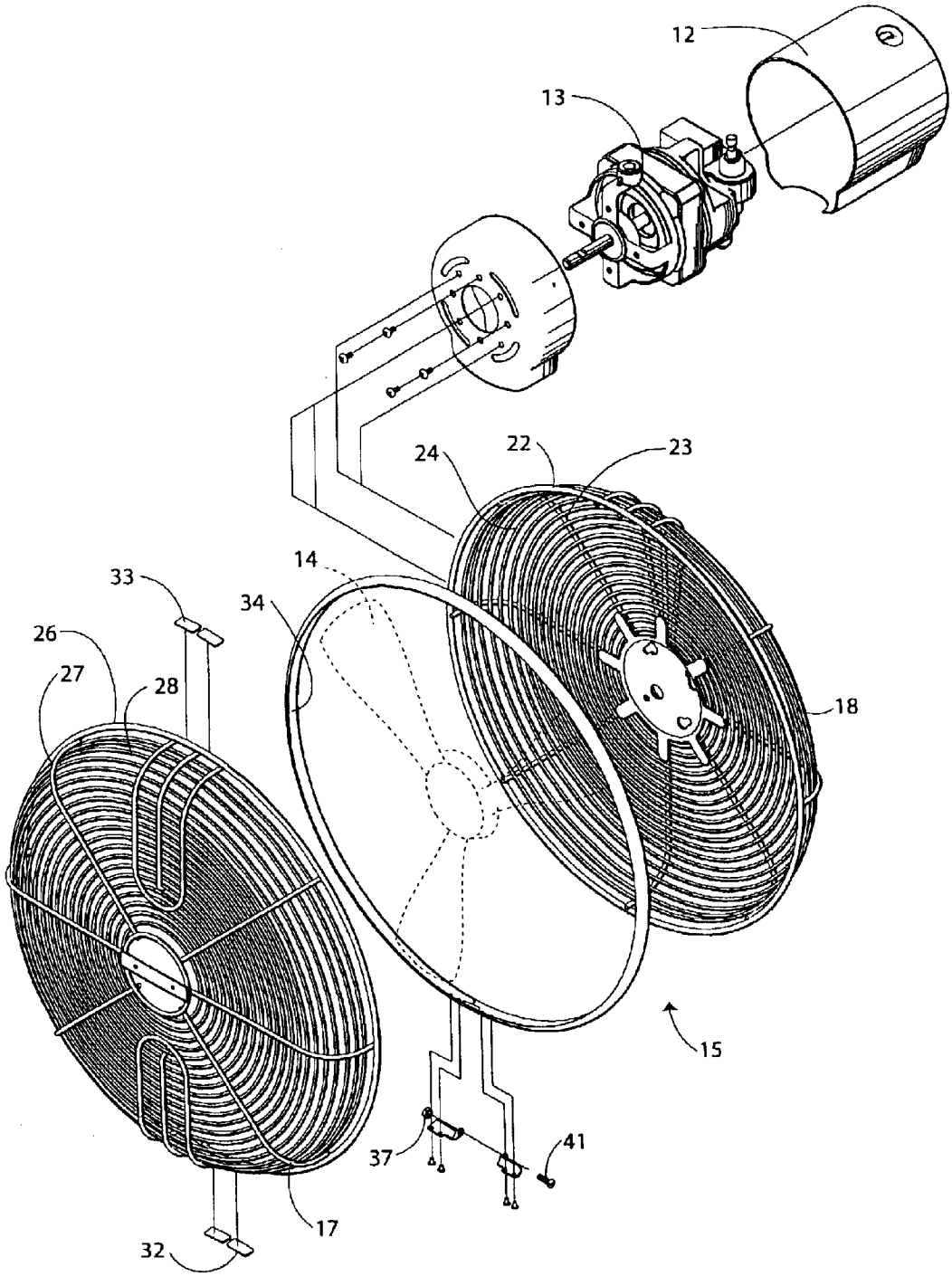
FIG. 1 is a perspective view of the grill assembly of a fan that embodies principles of the invention in its preferred form.
Figure 2:
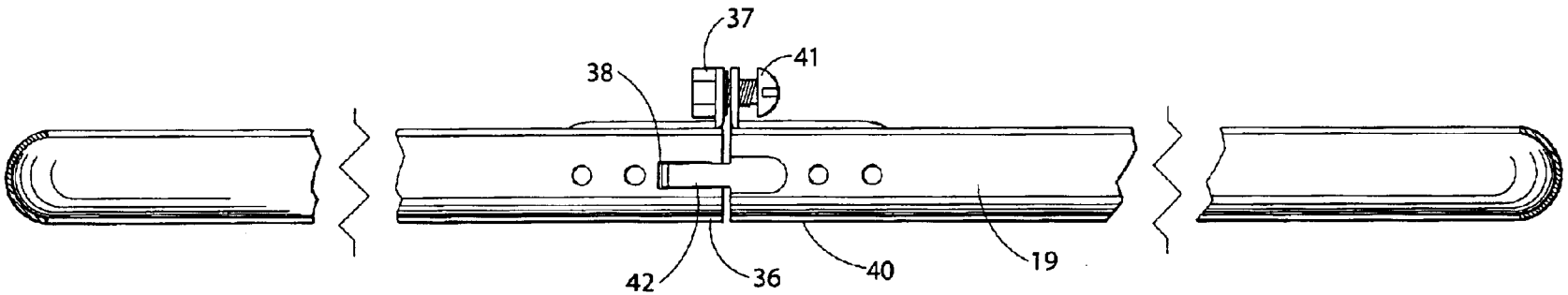
FIG. 2 is a detailed view of the mounting ring of the fan of FIG. 1.

With reference next to the drawings, there is shown a fan 10 having a base 11, a motor housing 12 encasing an electric motor 13, a blade assembly 14 coupled to the motor 13, and a protective grill assembly 15 surrounding the blade assembly 9. The electric motor 13 is connected to a source of electric power by wires that extend through the base 11. The electric motor rotatably drives the blade assembly 14 to produce an airflow.

The grill assembly 15 includes a front grill or grill half 17, a rear grill or grill half 18 and a split mounting ring 19. The rear grill 18 includes a peripheral rim 22, an annular array of ribs 23, and a concentric array of circular rods 24. Similarly, the front grill 17 includes a peripheral rim 26, an annular array of ribs 27, and a concentric array of circular rods 28. The front grill 17 also includes a bottom flange 32 and a top flange 33. The bottom flange 32 and top flange 33 are configured to releasably engage the peripheral rim 22 of the rear grill 18. The bottom flange and top flange may alternately be mounted to the rear grill and be configured to releasably engage the peripheral rim of the front grill.

The split mounting ring 19 has an inwardly facing channel 34 therein sized and shaped to encase substantially the peripheral rims 22 and 26 of the rear and front grills 18 and 17, respectively. The mounting ring 19 has a first end 36 having an internally threaded receiver 37 and a catch or slot 38 therein. The mounting ring 19 also has a second end 40 having a mounting bolt 41 rotatably mounted thereto which is configured to be threadably received within the first end receiver 37, and a spring biased latch 42 configured to be releasably received within the first end catch 38.

Figure 4:
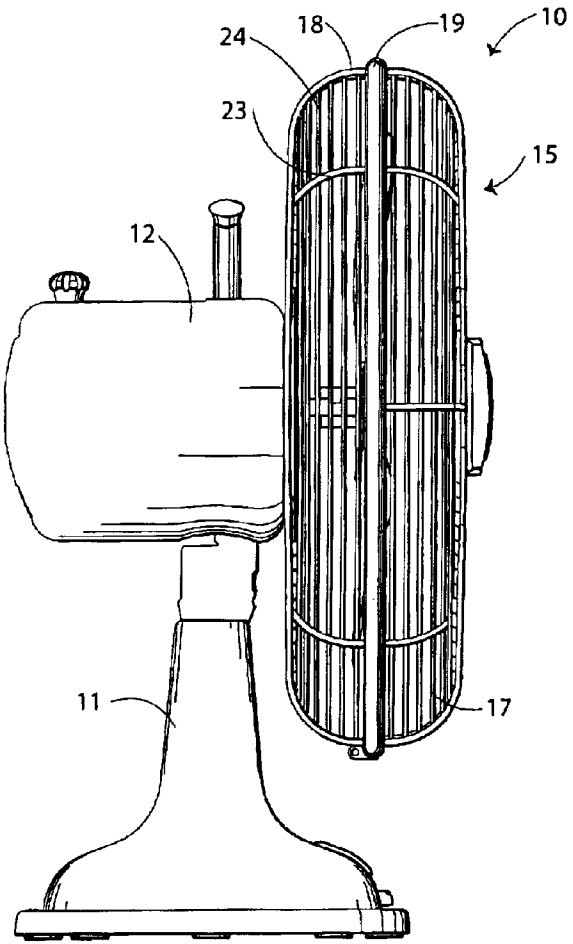
FIG. 4 is a side view of a fan having the grill assembly of FIG. 1, shown with the grill assembly in a mounted position.
Figure 3:
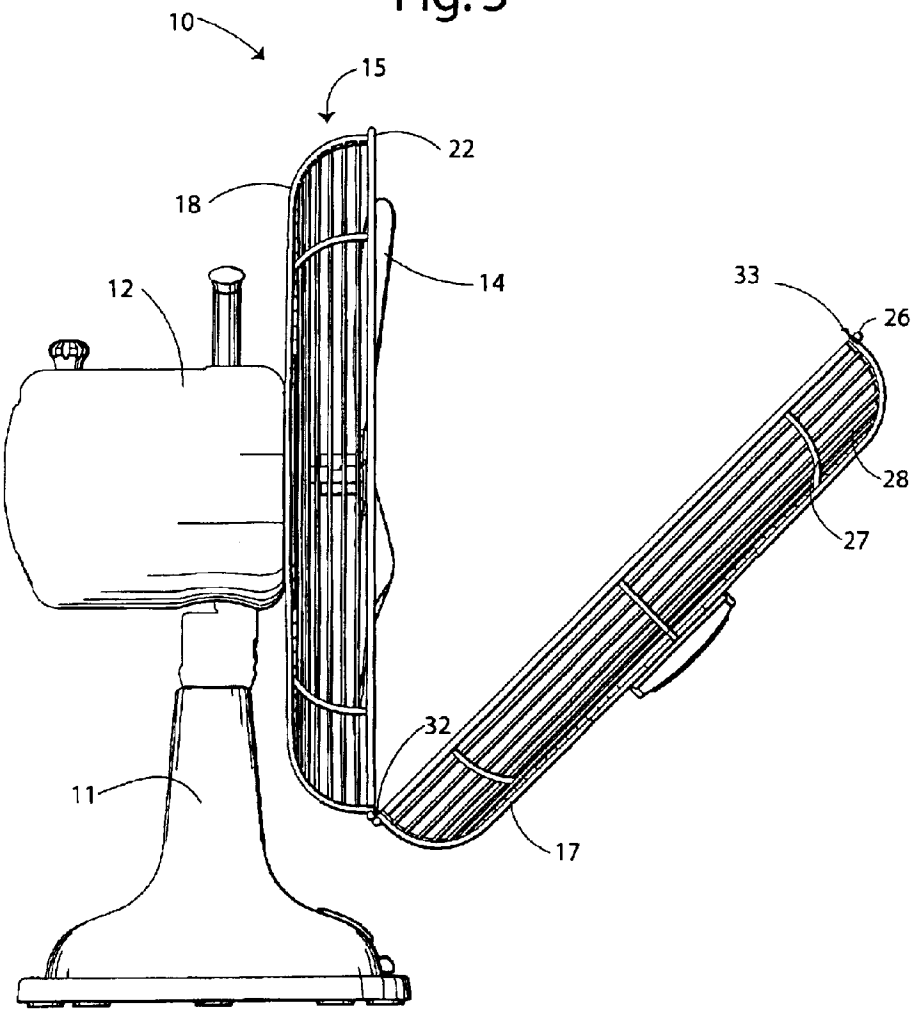
FIG. 3 is a side view of a fan having the grill assembly of FIG. 1, shown with the grill assembly in an unmounted position.

In use, a person assembles the grill assembly 15 by positioning the bottom flange 32 of the front grill 17 onto the peripheral rim 22 of the rear grill 18, as shown in FIG. 3. The front grill 17 is then rotated about the bottom flange 32 to a position wherein the first grill peripheral rim 26 abuts the rear grill peripheral rim 22 and the top flange 33 engages the peripheral rim 22 of the rear grill 18, as shown in FIG. 4. With the front grill 17 in this position the bottom and top flanges 32 and 33 temporarily hold the front and rear grills together, thus allowing a person to manipulate the mounting ring 19 independently of holding these two halves in position.

Figure 5:
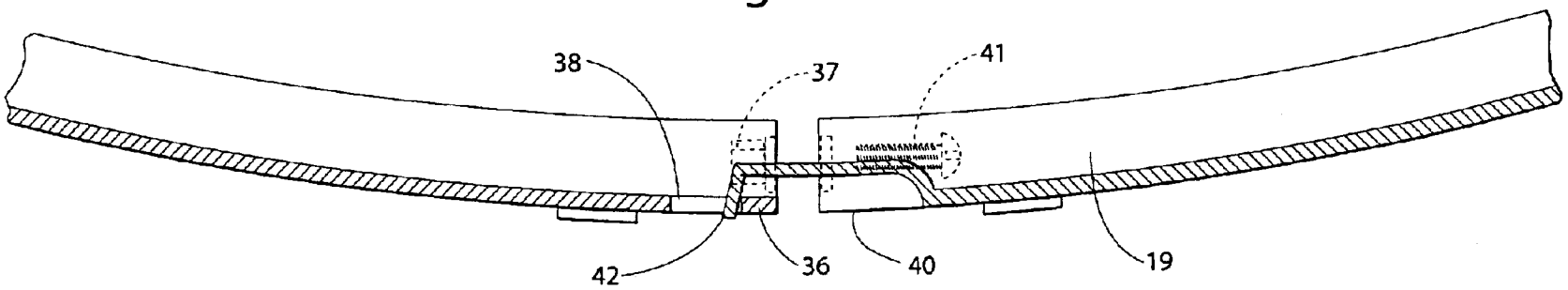
FIG. 5 is a detailed view of the mounting ring of the fan of FIG. 2, shown in a loose position.

The mounting ring 19 is then mounted by slightly expanding the ring 19 so that it easily extends over the peripheral rims 26 and 22 of the front and rear grills. The first end 36 and second end 40 of the mounting ring 19 are then brought together so as to capture the peripheral rims 26 and 22 within the mounting ring channel 34. Simultaneously, the second end latch 42 is positioned within the first end catch or slot 38, thereby preventing the mounting ring 19 from expanding once the person releases the manual pressure applied to the mounting ring. With the latch 42 received within the catch 38 the mounting ring 19 is temporarily secured to the front and rear grills and it is prevented from expanding, as shown in FIG. 5.

Figure 6:
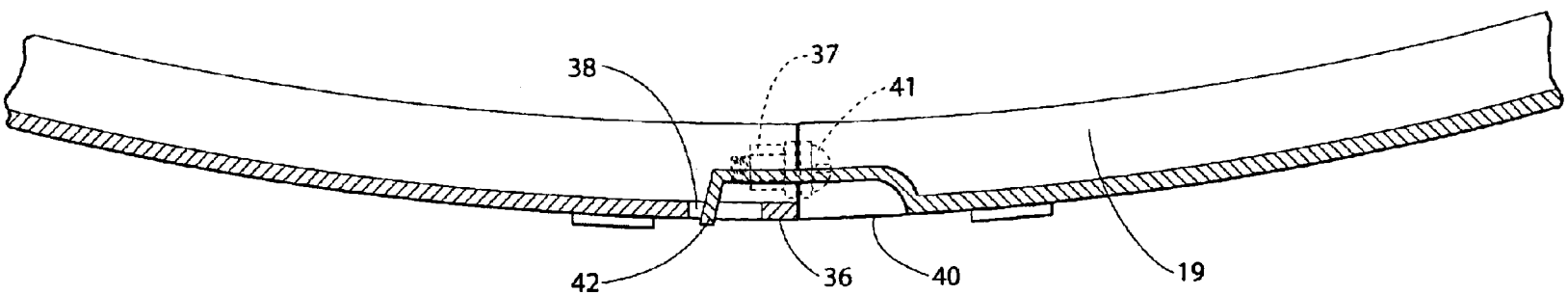
FIG. 6 is a detailed view of the mounting ring of the fan of FIG. 2, shown in a tightened position.

The person then threads the mounting bolt 41 of the second end 40 into the receiver 37 of the first end 36, thereby bringing the two ends together thereby slightly collapsing the mounting ring and fixedly capturing the peripheral rims 26 and 22 of the front and rear grills within the mounting ring channel 34, as shown in FIG. 6. As the two ends 36 and 40 move closer to each other the latch 42 simply moves along within the elongated catch or slot 38, i.e., the slot is configured to allow movement of the latch within the slot during the locking procedure of the mounting bolt 41. Once the bolt is fully threaded into the receiver the mounting process is complete.

The two grill halves may be separated from each other in order to clean the blade assembly by simply reversing the procedure.

Thus, it should be understood that one may assemble the two halves of the grill together, mount the mounting ring, and secure the mounting ring in place by threading the mounting bolt all without constantly holding these elements in place during each procedure.

It should be understood that as an alternative to the bolt 41 and receiver 37 shown in the preferred embodiment, other types of fasteners or locking means may be utilized. For example, other types of fasteners may include, but are not limited to, clasps, locking pins, latches, detents, and other similar devices. It should also be understood that the catch 38 may be in the form of a bar or other similar catching device rather then the slot shown in the preferred embodiment.

Lastly, it should also be understood that the present invention may also be incorporated into other types of fans, such as ceiling fans or pedestal fans. In a ceiling fan the motor housing, downrod, canopy and ceiling mount may be considered the base, in whole or in part.

It thus is seen that an improved fan grill assembly is now provided which enables the grill assembly to be mounted in place easily, quickly and in a reliable and secure manner. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A fan comprising, a base;

an electric motor coupled to said base;

an annular array of blades mounted to said motor;

a first grill half having a peripheral rim;

a second grill half having a peripheral rim; and a mounting ring having a channel therein sized and shaped to receive said first grill half peripheral rim and said second grill half peripheral rim, said mounting ring having a first end and a second end, one said end having a latch mounted thereon configured to be received by a catch associated with the other said end, said mounting ring also having locking means for locking said ends together, whereby the mounting ring captures the peripheral rims of the two grill halves and the ends are temporarily coupled together through the use of the latch and catch, and the ends are then locked together through the use of the locking means without requiring an installer to manually maintain the relative positions of the ends during the locking process.

2. The fan of claim 1 wherein said locking means comprises a threaded bolt coupled to one said mounting ring end and a threaded receiver coupled to the other said mounting ring end and configured to mate with said threaded bolt.

3. The fan of claim 2 wherein said latch and said bolt are coupled to said second end, and wherein said catch and said receiver are coupled to said first end.

4. The fan of claim 1 further comprising at least one mounting flange fixedly mounted to one said grill half and configured to releasably mate with the other said grill half, whereby the mounting flange may temporarily maintain the two grill halves together.

5. In a fan having a base, an electric motor, and a blade assembly, the improvement comprising:

a grill assembly having a front grill with a peripheral rim, a rear grill with a peripheral rim and a split mounting ring, the split mounting ring having a first end with a latch thereon configured to mate with a catch associated with a second end of said split mounting ring, and locking means coupled to said first and second ends for locking the first and second ends together, whereby the mounting ring captures the peripheral rims of the front and rear grills and the ends are temporarily coupled together through the use of the latch and catch, and the ends are then locked together through the use of the locking means without requiring an installer to manually maintain the relative positions of the ends during the locking process.

6. The fan of claim 5 wherein said locking means comprises a threaded bolt coupled to one said mounting ring end and a threaded receiver coupled to the other said mounting ring end and configured to mate with said threaded bolt.

7. The fan of claim 6 wherein said latch and said bolt are coupled to said second end, and wherein said catch and said receiver are coupled to said first end.

8. The fan of claim 5 further comprising at least one mounting flange fixedly mounted to either said front or rear grill and configured to releasably mate with the other said grill, whereby the mounting flange may temporarily maintain the front and rear grills together.

9. A fan comprising, a base;

an electric motor coupled to said base;

an annular array of blades mounted to said motor;

a first grill half having a peripheral rim;

a second grill half having a peripheral rim; and a split mounting ring having a first end, a second end, and a channel therein sized and shaped to receive said first grill peripheral rim and said second grill peripheral rim, said mounting ring having temporary holding means for temporarily holding said first and second mounting ring ends together, and locking means for locking said first and second ends together, whereby the mounting ring captures the peripheral rims of the two grill halves and the two ring ends are temporarily coupled together through the use of the temporary holding means, and the ends are then locked together through the use of the locking means without requiring an installer to manually maintain the relative positions of the ends during the locking process through the use of the holding means.

10. The fan of claim 9 wherein said holding means comprises a latch mounted to one said ring end, and a catch associated with the other said ring end, said latch being configured to engage said catch.

11. The fan of claim 10 wherein said locking means comprises a threaded bolt coupled to one said mounting ring end and a threaded receiver coupled to the other said mounting ring end and configured to mate with said threaded bolt.

12. The fan of claim 11 wherein said latch and said bolt are coupled to said second end, and wherein said catch and said receiver are coupled to said first end.

13. The fan of claim 9 further comprising at least one mounting flange fixedly mounted to one said grill half and configured to releasably mate with the other said grill half, whereby the mounting flange may temporarily maintain the two grill halves together.

* * * * *